US011179734B2

(12) United States Patent
Lee et al.

(10) Patent No.: US 11,179,734 B2
(45) Date of Patent: Nov. 23, 2021

(54) COMBINED MULTI-PURPOSE HANDHELD SHOWER AND SHOWERHEAD

(71) Applicant: Delta Faucet Company, Indianapolis, IN (US)

(72) Inventors: David Lee, Durham, NC (US); ShengJun Du, Xiamen (CN); Lei Wang, Guang shui (CN); ShengChao Dai, Xiamen (CN); ZhaoYi Zhuo, Xiamen (CN); Martin Jennings Kimbell, Wauconda, IL (US); Michael Alan Miller, Fishers, IN (US)

(73) Assignee: Delta Faucet Company, Indianapolis, IN (US)

( * ) Notice: Subject to any disclaimer, the term of this patent is extended or adjusted under 35 U.S.C. 154(b) by 56 days.

(21) Appl. No.: 16/206,296

(22) Filed: Nov. 30, 2018

(65) Prior Publication Data

US 2019/0176170 A1 Jun. 13, 2019

Related U.S. Application Data

(60) Provisional application No. 62/596,606, filed on Dec. 8, 2017.

(51) Int. Cl.

| | |
|---|---|
| ***B05B 1/18*** | (2006.01) |
| ***E03C 1/06*** | (2006.01) |
| ***B05B 1/16*** | (2006.01) |
| ***B05B 1/30*** | (2006.01) |
| ***B05B 15/62*** | (2018.01) |
| ***A47L 13/10*** | (2006.01) |
| *B05B 15/652* | (2018.01) |
| *A47K 7/02* | (2006.01) |

(52) U.S. Cl.
CPC ..... *B05B 1/185* (2013.01); *A47L 13/10* (2013.01); *B05B 1/1618* (2013.01); *B05B 1/30* (2013.01); *B05B 1/3026* (2013.01); *B05B 15/62* (2018.02); *E03C 1/06* (2013.01); *A47K 7/02* (2013.01); *B05B 15/652* (2018.02)

(58) Field of Classification Search
CPC ..... B05B 1/18; B05B 1/185
USPC ..... 239/197, 562, 588; 403/32, 325, 326, 403/327, 328
See application file for complete search history.

(56) References Cited

U.S. PATENT DOCUMENTS 2,902,065 A * 9/1959 Graves ..... B27B 17/0083 30/371
4,027,984 A 6/1977 Underwood
5,109,553 A 5/1992 Kishimoto
(Continued)

FOREIGN PATENT DOCUMENTS

CN 200957383 Y 10/2007
CN 200981029 Y 11/2007
(Continued)

*Primary Examiner* — Viet Le
(74) *Attorney, Agent, or Firm* — Bose McKinney & Evans LLP

(57) ABSTRACT

The present disclosure is directed to a shower assembly in which a handheld shower is removably coupled to a showerhead, where the showerhead has a holder configured to retain the handheld shower. The handheld shower can be inserted into the holder in different ways, while the handheld shower can be removed by first pivoting the handheld shower within the recess followed by extraction from the recess.

15 Claims, 18 Drawing Sheets

(56) References Cited

U.S. PATENT DOCUMENTS 5,246,301 A * 9/1993 Hirasawa ..... A46B 11/063 401/28
6,024,331 A * 2/2000 Bischoff ..... E03C 1/06 248/229.1
6,149,170 A * 11/2000 Dotson ..... A61H 3/04 280/267
D438,708 S 3/2001 Weiner
6,227,755 B1 * 5/2001 Hata ..... E05C 19/024 403/322.1
6,361,005 B1 * 3/2002 Faisst ..... E03C 1/06 248/218.4
6,719,531 B2 * 4/2004 Wu ..... F04D 25/088 403/322.1
D509,561 S * 9/2005 Kobi ..... D23/213
7,360,723 B2 * 4/2008 Lev ..... B05B 1/16 239/442
7,395,578 B2 * 7/2008 Huang ..... B60S 1/3851 15/250.32
7,426,757 B2 9/2008 Lev et al.
7,665,676 B2 2/2010 Lev
7,871,020 B2 1/2011 Nelson et al.
7,900,295 B2 * 3/2011 Lev ..... B05B 1/1672 4/615
7,900,296 B2 3/2011 Lev et al.
8,028,935 B2 10/2011 Leber
8,061,631 B2 11/2011 Lev
8,881,993 B2 11/2014 Lev
9,149,817 B2 * 10/2015 Lev ..... E03C 1/0409
9,399,860 B2 7/2016 Lev
9,521,898 B2 12/2016 Knight
9,828,752 B2 11/2017 Genord et al.
2007/0022528 A1 2/2007 Gilbert
2009/0007330 A1 * 1/2009 Genord ..... B05B 15/62 4/695
2015/0090812 A1 * 4/2015 Wu ..... E03C 1/0409 239/446
2016/0236223 A1 * 8/2016 Scheffer ..... B05B 15/62
2017/0145671 A1 5/2017 Genord et al.

FOREIGN PATENT DOCUMENTS

CN 201558759 U 8/2010
CN 203664079 U 6/2014
CN 204383610 U 6/2015
CN 207864348 U 9/2018
KR 20170034635 A 3/2017

* cited by examiner

COMBINED MULTI-PURPOSE HANDHELD SHOWER AND SHOWERHEAD

CROSS-REFERENCE TO RELATED APPLICATION

The present application claims priority to U.S. Provisional Patent Application Ser. No. 62/596,606, filed Dec. 8, 2017, the disclosure of which is expressly incorporated hereby reference.

BACKGROUND AND SUMMARY

The present invention relates generally to showerheads and, more particularly, to a handheld shower releasably coupled to a fixed showerhead.

It is known to provide a handheld shower removably coupled to a showerhead. However, conventional coupling mechanisms between the handheld shower and the showerhead may permit the handheld shower to unintentionally uncouple from the showerhead. As such, combined handheld showers and showerheads with improved coupling mechanisms are desired.

The present disclosure is directed to a shower assembly in which a handheld shower is removably coupled to a showerhead, where the showerhead has a retainer configured to couple the handheld shower to the showerhead. In an illustrative embodiment, the retainer includes a nest wherein handheld shower can be inserted into nest in different ways while the handheld shower can be removed by first rotating the handheld shower within the nest followed by extraction from the nest.

According to an illustrative embodiment of the present disclosure, a shower assembly includes a showerhead having a faceplate with a plurality of outlets and defining a first longitudinal axis. The showerhead includes a spring biased latch and a docking protrusion. A handheld shower is removably coupled to the showerhead and includes a faceplate having a plurality of outlets and defining a second longitudinal axis. The handheld shower further includes a retainer configured to couple with the spring biased latch, the retainer including a recess having a third axis parallel with the second axis, and the spring biased latch configured to move along the third axis. When the handheld shower is coupled to the showerhead, the spring biased latch is received in the recess and the docking protrusion is coupled to the outer surface of the handheld shower.

According to another illustrative embodiment of the present disclosure, a method of coupling a showerhead and a handheld shower of a shower assembly includes the steps of inserting a handheld shower within a holder of a showerhead, wherein the holder forms a recess within the showerhead and the holder includes a latch and a docking protrusion, wherein the latch is coupled to a spring, and coupling a retainer to the handheld shower to the latch. The method further includes the step of coupling an outer surface of the handheld shower to the docking protrusion of the passage.

In a further illustrative embodiment of the present disclosure, a method for removing a handheld shower from a showerhead of a shower assembly includes the steps of uncoupling the handheld shower from a docking protrusion of the showerhead, and pivoting the handheld shower away from the docking protrusion. The method further includes the step of uncoupling a retainer of the handheld shower from the latch of the showerhead, the latch being coupled to a spring.

In another illustrative embodiment of the present disclosure, a shower assembly includes a showerhead having a faceplate with a plurality of outlets, and a handheld shower fluidly coupled to the showerhead and extending between a proximal and a distal end. The handheld shower includes a shell, a waterway received within the shell, a faceplate coupled to the shell, the faceplate including a plurality of outlets fluidly coupled to the waterway, and a retainer coupled to the shell. A holder is configured to secure the handheld shower to the showerhead, the holder including an arcuate nest to receive the shell of the handheld shower, and a spring biased latch to receive the retainer of the shower. The handheld shower and the holder define a first coupling mode where the handheld shower pivots about a proximal pivot point proximate the proximal end of the handheld shower wherein the spring biased latch is received within the retainer of the handheld shower. The handheld shower and the holder define a second coupling mode where the handheld shower pivots about a distal pivot point proximate the distal end of the handheld shower wherein the spring biased latch is received within the retainer of the handheld shower.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1A:
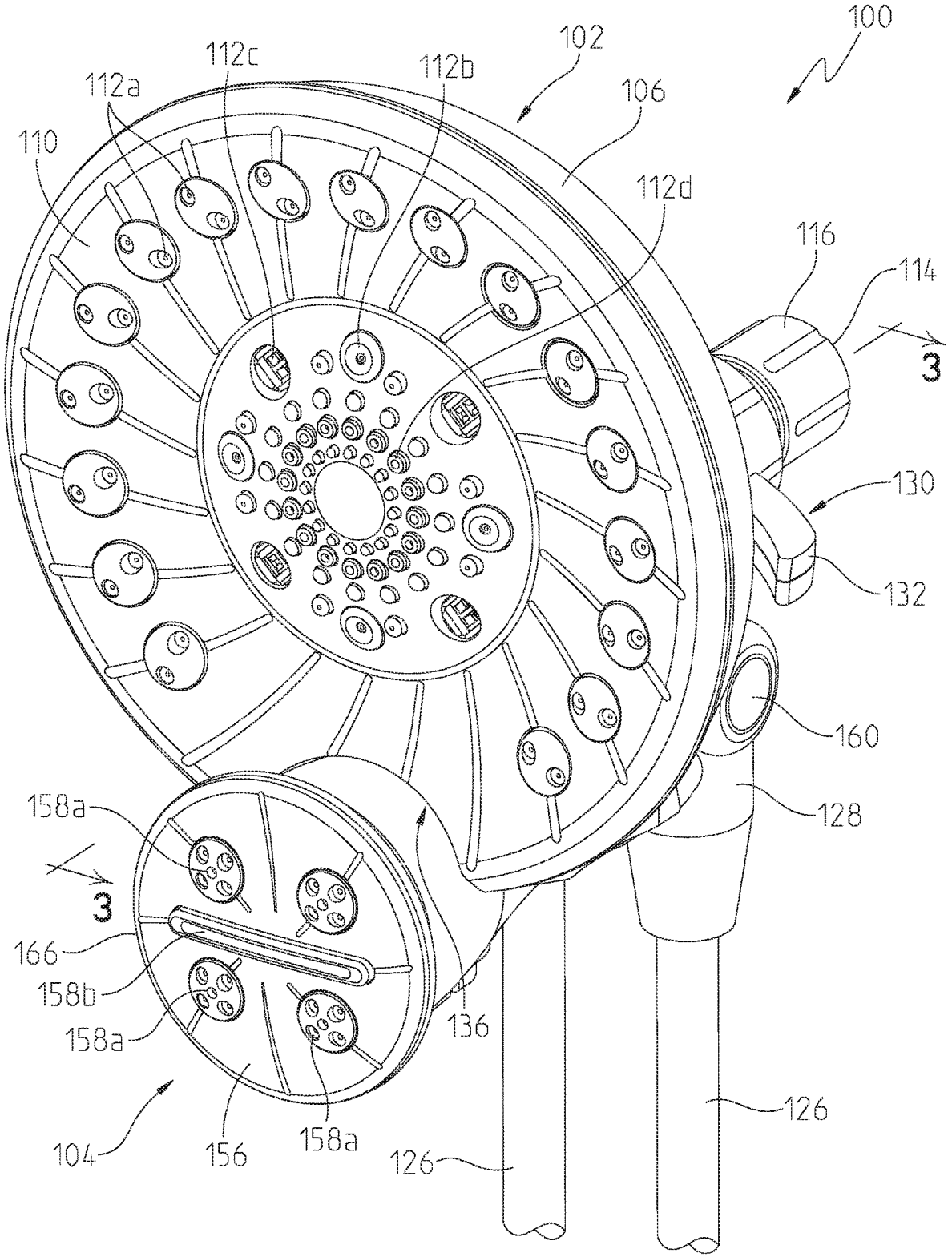
FIG. 1A is a front perspective view of an illustrative shower assembly including a showerhead and a handheld shower in accordance with the present disclosure.
Figure 1B:
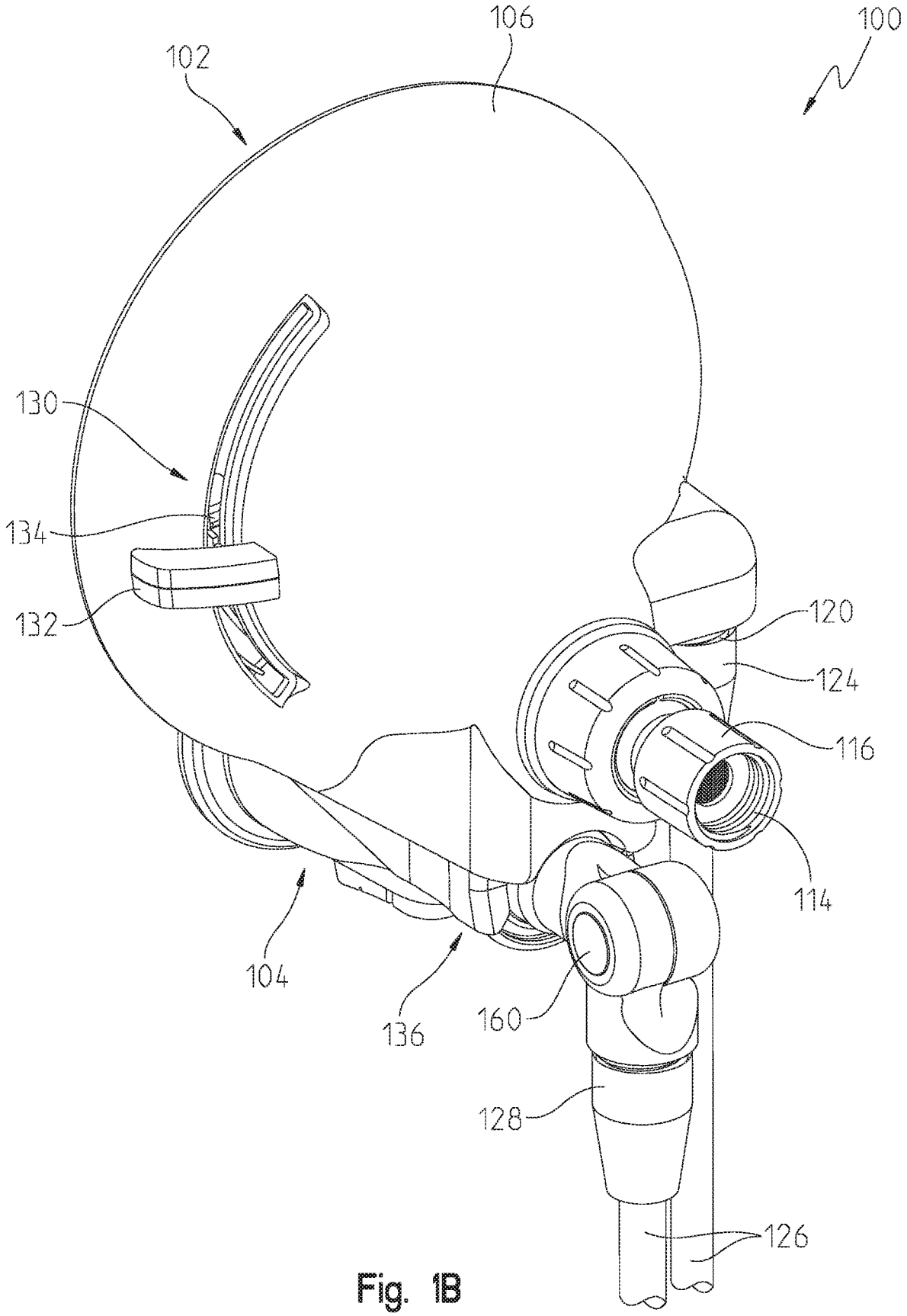
FIG. 1B is a rear perspective view of the illustrative shower assembly of FIG. 1A.
Figure 2A:
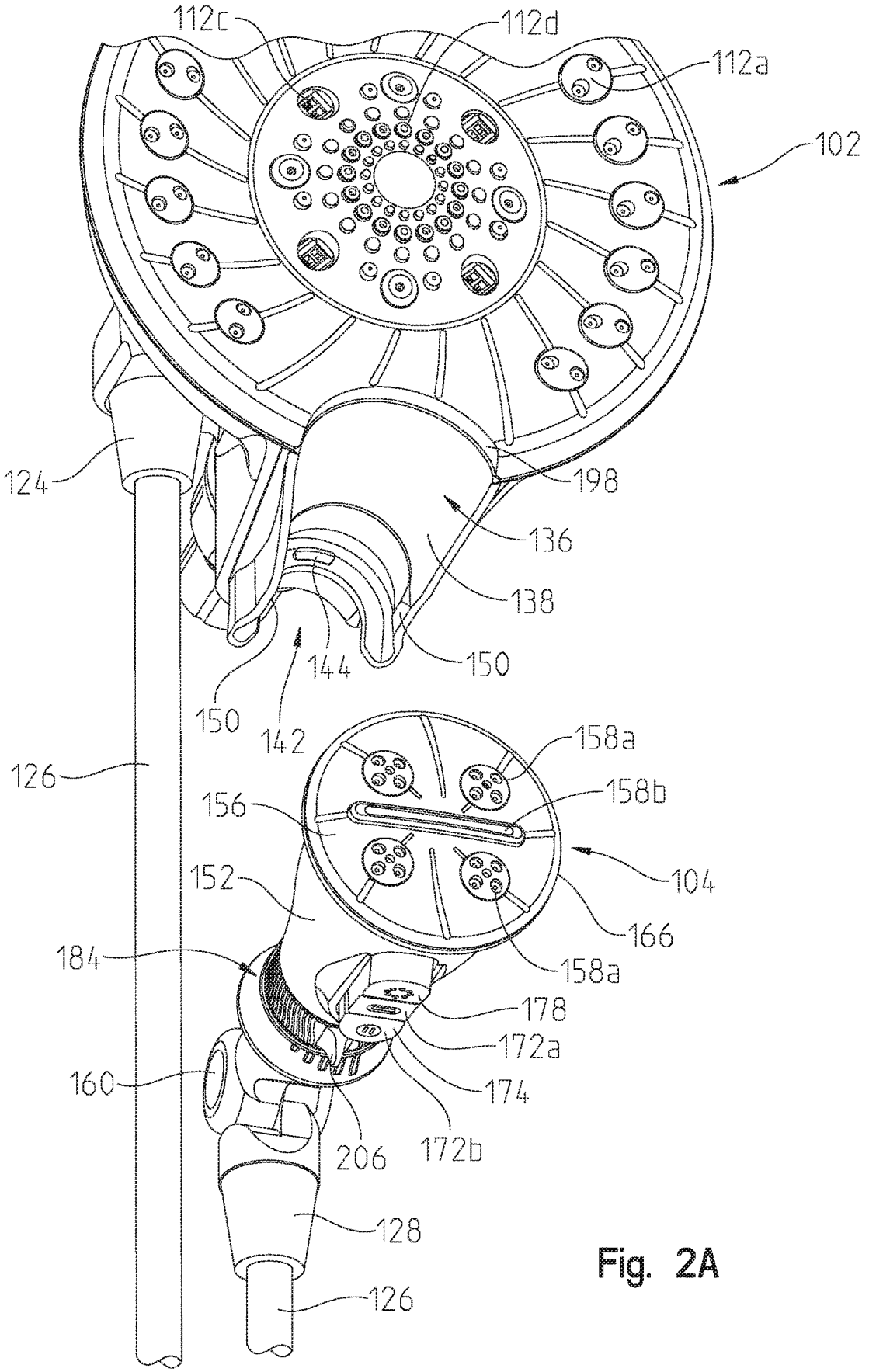
FIG. 2 is a bottom, perspective view of a the shower assembly of FIG. 1, with the handheld shower removed from the showerhead.
Figure 2B:
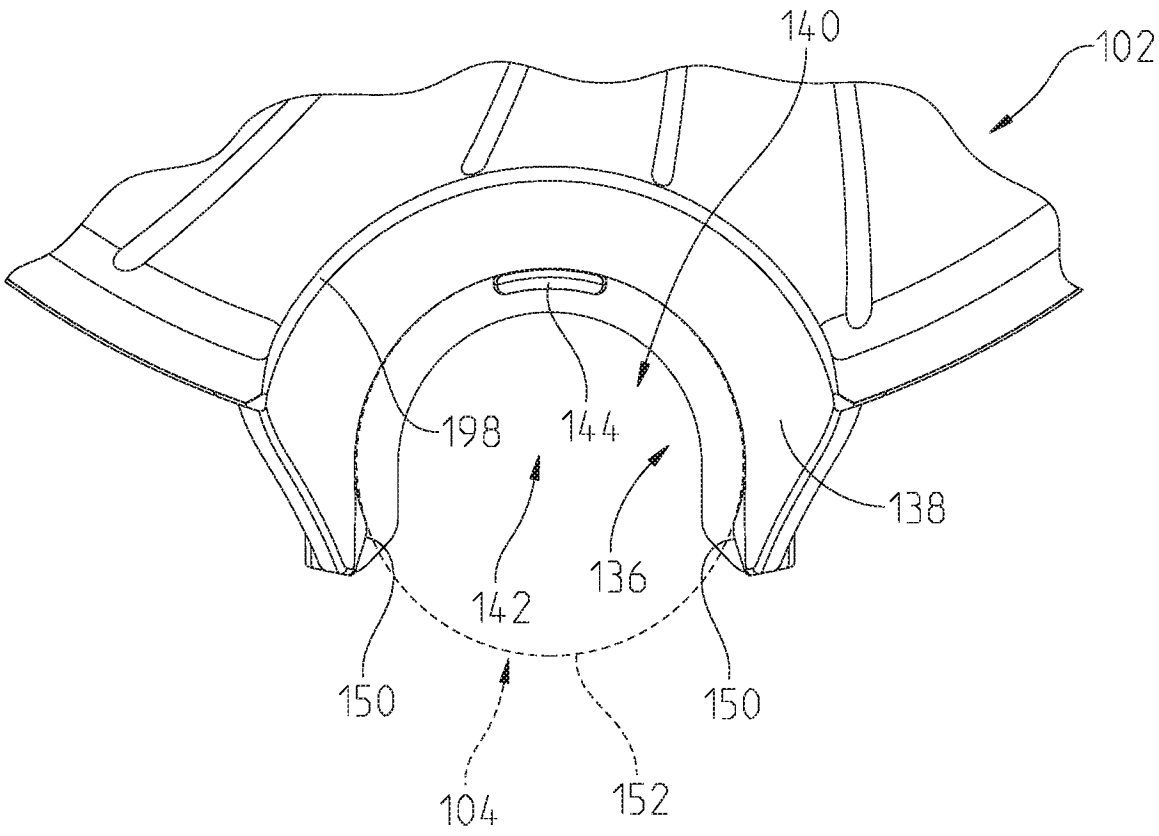

Referring initially to FIGS. 1 and 2, an illustrative shower assembly 100 is shown in a coupled configuration. Shower assembly 100 includes a showerhead 102 and a handheld shower 104. Showerhead 102 and handheld shower 104 are removably coupled to each other as discussed further herein, and when in the coupled configuration, showerhead 102 and handheld shower 104 have axes A and B, respectively (FIG. 6) that are parallel with each other. As further shown in FIG. 6, the axes A and B are vertically offset. In other configurations, the axes A and B may be horizontally offset, both vertically and horizontally offset, or coaxially aligned.

Showerhead 102 includes a body or shell 106 receiving a waterway 108. A faceplate 110 is supported by the shell 106 and includes a plurality of outlets 112. The waterway is in fluid communication with the outlets 112 and a showerhead inlet 114. The showerhead inlet 114 is connected to an external water source/supply (not shown), such that water can exit through outlets 112. The showerhead inlet 114 illustratively includes a coupler 116 configured to be fluidly coupled to a conventional shower arm (not shown). The coupler 116 may include a ball and socket connector 118 to provide pivoting adjustment of the showerhead 102 in at least two, illustratively three, orthogonal axes. An outlet 120 of the showerhead 102 is fluidly coupled to an inlet 122 of the handheld shower 104. More particularly, a first fluid coupler 124 fluidly couples an inlet of a flexible hose 126 to the showerhead 102, and a second fluid coupler 128 fluidly couples an outlet of the flexible hose 126 to the handheld shower 104.

A diverter 130 is received within the shell 106 and is fluidly coupled to the waterway 108. The diverter 130 is configured to alter the modes of operation of the showerhead. More particularly, the diverter 130 includes a user interface, illustratively a handle 132 supported for movement within an arcuate slot 134. Movement of the handle 132 between different discrete positions along the slot 134 causes a diverter valve to alter the flow between different outlets 112 in the faceplate 110. For example, outlets **112*b* may provide a massage spray mode, outlets 112*a* may provide a conventional full spray mode, and outlets 112*c* may provide a fluidic device spray mode. Movement of the handle 132 may also change the position of the diverter 130 for altering water flow to the additional modes, such as showerhead outlet 120 only (and handheld shower 104), and to the showerhead outlet 120 (and handheld shower 104) simultaneously to the showerhead conventional spray defined by outlets 112*a*. As such, there are illustratively five different modes defined by the showerhead diverter 130: (1) showerhead full spray mode, (2) showerhead massage mode, (3) showerhead fluidics mode, (4) showerhead full spray and handshower mode, and (5) handshower only. It should be appreciated that the number and types of modes may be altered. Additionally, the diverter 130 may be separated into separate devices, a first diverter for controlling flow through the different outlets 112 of the showerhead 102, and a second diverter for controlling flow between the showerhead 102 and the handheld shower 104**.

As shown in FIG. 2, showerhead 102 further includes a holder 136, illustratively an arcuate nest 138 that forms a recess 140. The nest 138 is illustratively supported by the shell at a lower portion thereof (e.g. at a 6 o'clock position) and extends along at least a portion of the length of the showerhead 102 substantially parallel to the longitudinal axis A. Recess 140 is configured to receive handheld shower 104. The arcuate nest 138 further provides a coupling mechanism 142 to couple handheld shower 104 to showerhead 102 within recess 140 resulting in the coupled configuration shown in FIG. 1. The coupling mechanism of the arcuate nest 138 illustratively includes a retractable latch 144 supported by the nest 138 of the showerhead 102, and a cooperating retainer 146 supported by the handheld shower 104. The latch 144 is illustratively biased outwardly by a spring 147. As shown, cooperating couplers, such as docking protrusions 150, are illustratively positioned below latch 144 within nest 138 in order to accommodate and retain handheld shower 104. It should be appreciated that other couplers may be used in combination with, or instead of, docking protrusions 150. For example, docking protrusions 150 may be replaced by a magnet supported by the showerhead 102 and a magnetically attractive material (or another magnet) supported by the handheld shower 104. Interaction between retainer 146 and latch 144, and docking protrusions 150 and handheld shower 104, to retain handheld shower 104 within the nest 138 is further discussed further herein.

Figure 10:
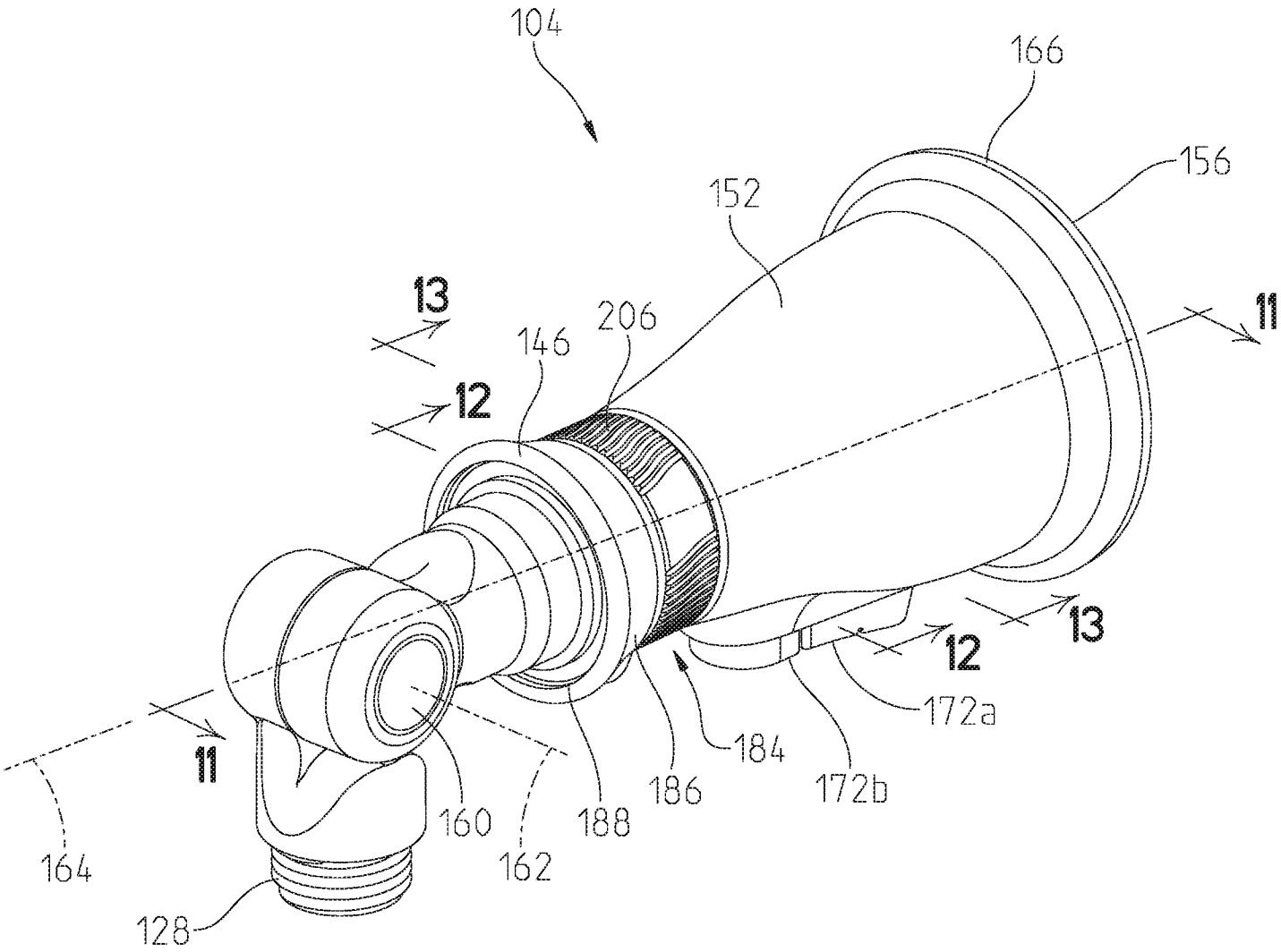
FIG. 10 is a perspective view of the handheld shower of FIG. 1.
Figure 11:
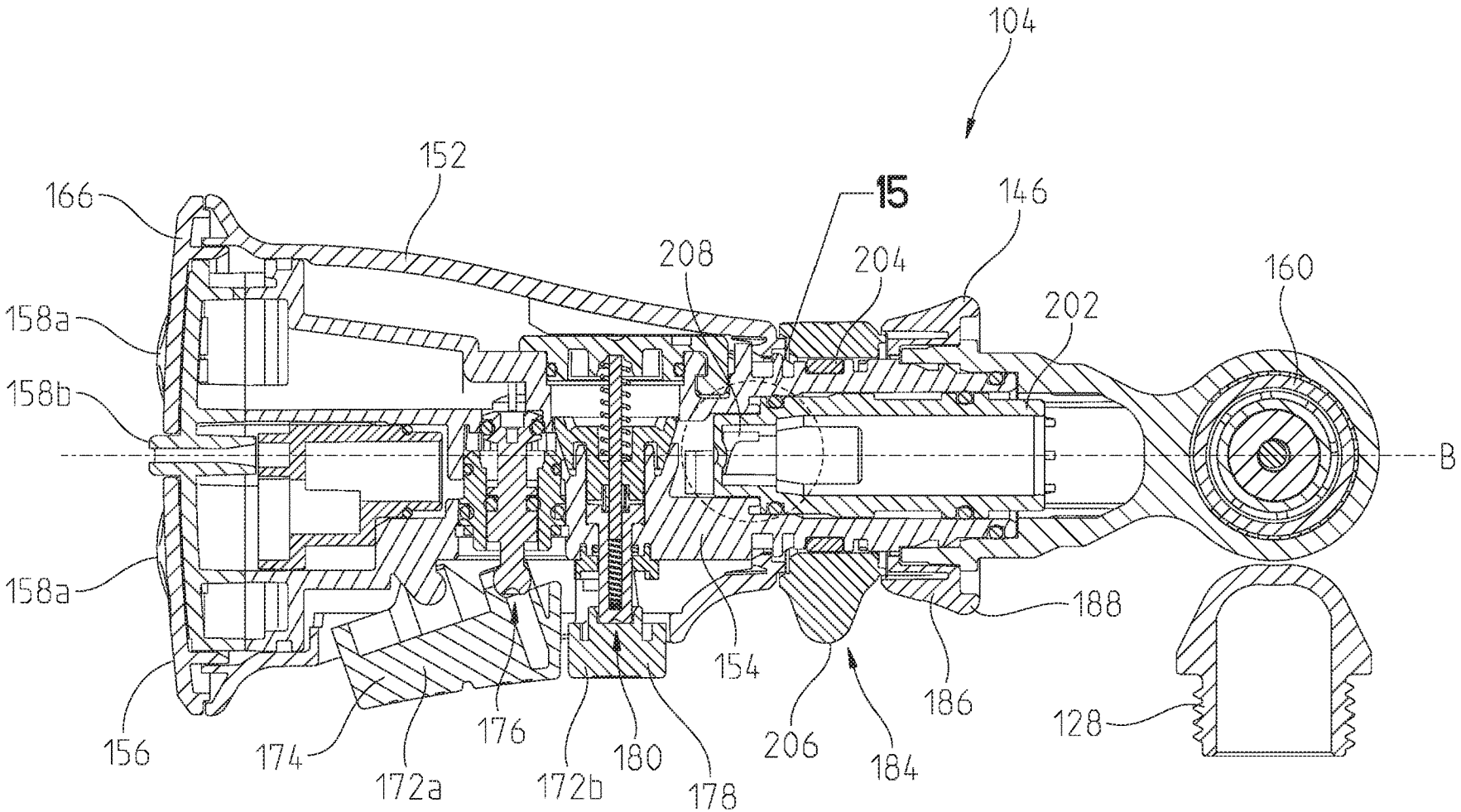
FIG. 11 is a cross-sectional view of the handheld shower of FIG. 10 taken along line 11-11.
Figure 12:
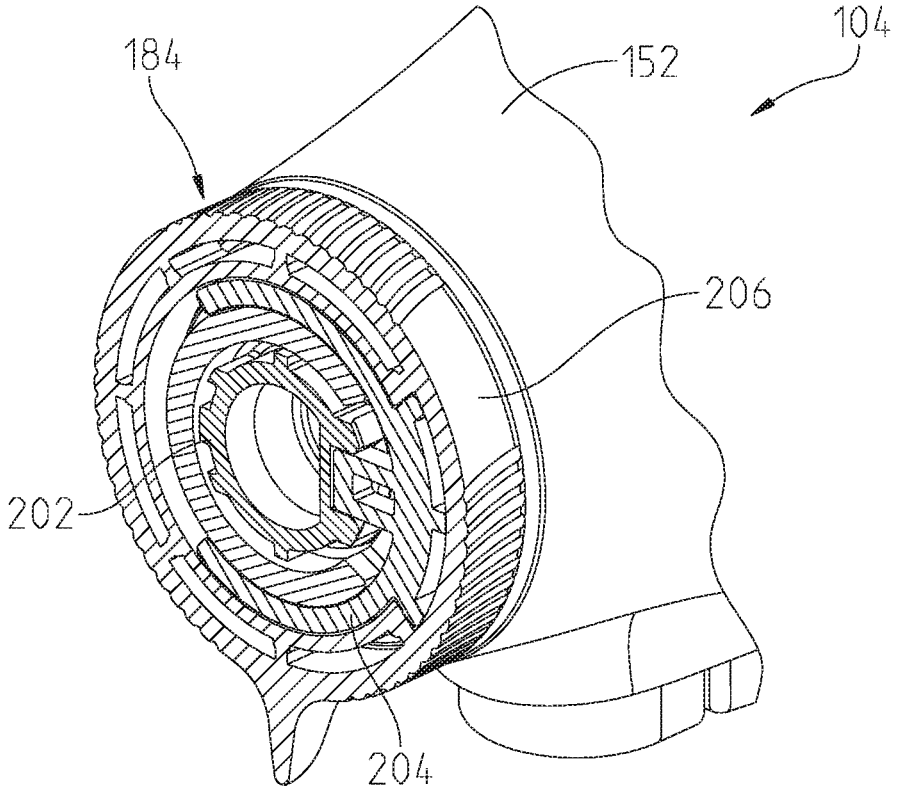
FIG. 12 is a cross-sectional view of the handheld shower of FIG. 10 taken along line 12-12.
Figure 13:
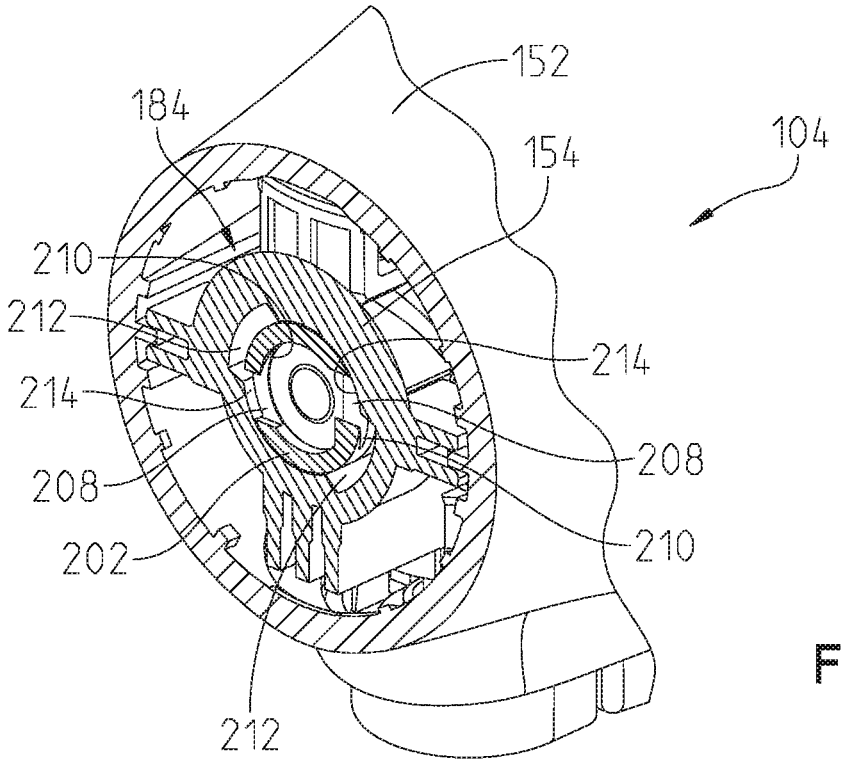
FIG. 13 is a cross-sectional view of the handheld shower of FIG. 10 taken along line 13-13.
Figure 14:
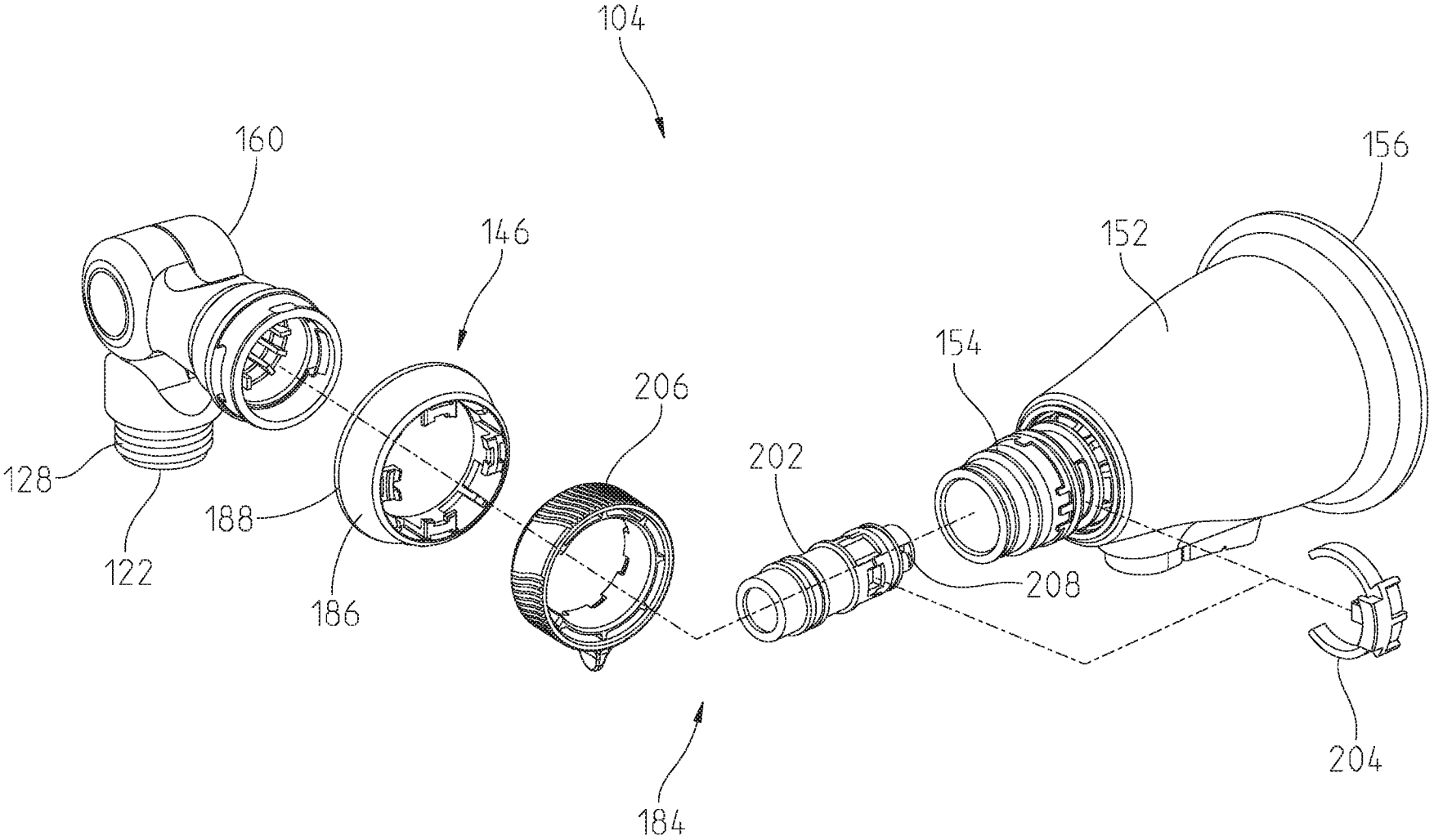
FIG. 14 is an exploded perspective view of the handheld shower of FIG. 10.

Handheld shower 104 illustratively includes a body or shell 152 receiving a waterway 154. A faceplate 156 is supported by the shell 152 and includes a plurality of outlets 158 that are in fluid communication with the waterway. Outlets **158*a* illustratively comprise spray nozzles, while outlet 158*b* illustratively comprises a stream outlet. The waterway 154 is in fluid communication with the hose 126 which provides a conduit for water to flow from the showerhead 102, into handheld shower 104 and out of outlets 158. Hose 126 is coupled to handheld shower 104 by coupler 128. Coupler 128 is coupled to a hinge 160 of handheld shower 104. Hinge 160 allows for a user to adjust the orientation of handheld shower 104 by pivoting handheld shower 104 about hinge 160. In one embodiment, hinge 160 allows for handheld shower 104 to pivot about a first axis 162 by approximately 254 degrees, and to pivot about a second axis 164 by 360 degrees (FIG. 10). Handheld shower 104 further includes a rim 166 configured to receive a scrubbing attachment (FIGS. 18-21**) as discussed further herein.

Handheld shower 104 also includes controls to manage the operating settings of handheld shower 104. That is, handheld shower 104 can control the mode of operation and the flow rate of water dispensed through outlets 158 of handheld shower 104. To control the operating modes of handheld shower 104, handheld shower 104 includes a plurality of user interface inputs or buttons 172. For example, plurality of buttons 172 may include a mode button 172*a* to toggle the mode of handheld shower 104 (e.g., spray, stream, etc.), and a button 172*b* to toggle the operation of the handheld shower (e.g., pause button). More particularly, the mode button 172*a* illustratively includes a rocker switch 174 operably coupled to a mode valve 176 configured to move in response to operation of the rocker switch 174 and direct water flow to different outlets 158 in the faceplate 156. In a spray mode, the mode valve 176 directs water to outlets 158*a* to provide a spray of water. In a stream mode, the mode valve 176 directs water to outlet 158*b* to provide a stream of water, illustratively a blade of water.

The pause mode button 172*b* illustratively includes a push button 178 operably coupled to a pause valve 180 configured to move between a default position where water flows from the inlet 122 to the mode valve 176, and a pause position where water flow is restricted (e.g., significantly reduced) from flowing to the mode valve 176 (and hence the outlets 158). It is within the scope of the present disclosure that buttons 172 may control other features of handheld shower 104.

Handheld shower 104 further includes a volumetric flow control 184 configured to control the volumetric flow rate of water through outlets 158. Volumetric flow control 184 can be moved along the outer edge of handheld shower to adjust the size of a flow control aperture 185 (FIGS. 15-17) and thereby, the volumetric flow rate as discussed further herein.

Handheld shower 104 further includes retainer 146 that assists in coupling handheld shower 104 to showerhead 102 by its engagement with latch 144 as discussed further herein. The retainer 146 is illustratively defined by an annular ring or clip 186 including a lip or ridge 188 configured to engage with the latch 144.

Figure 3:
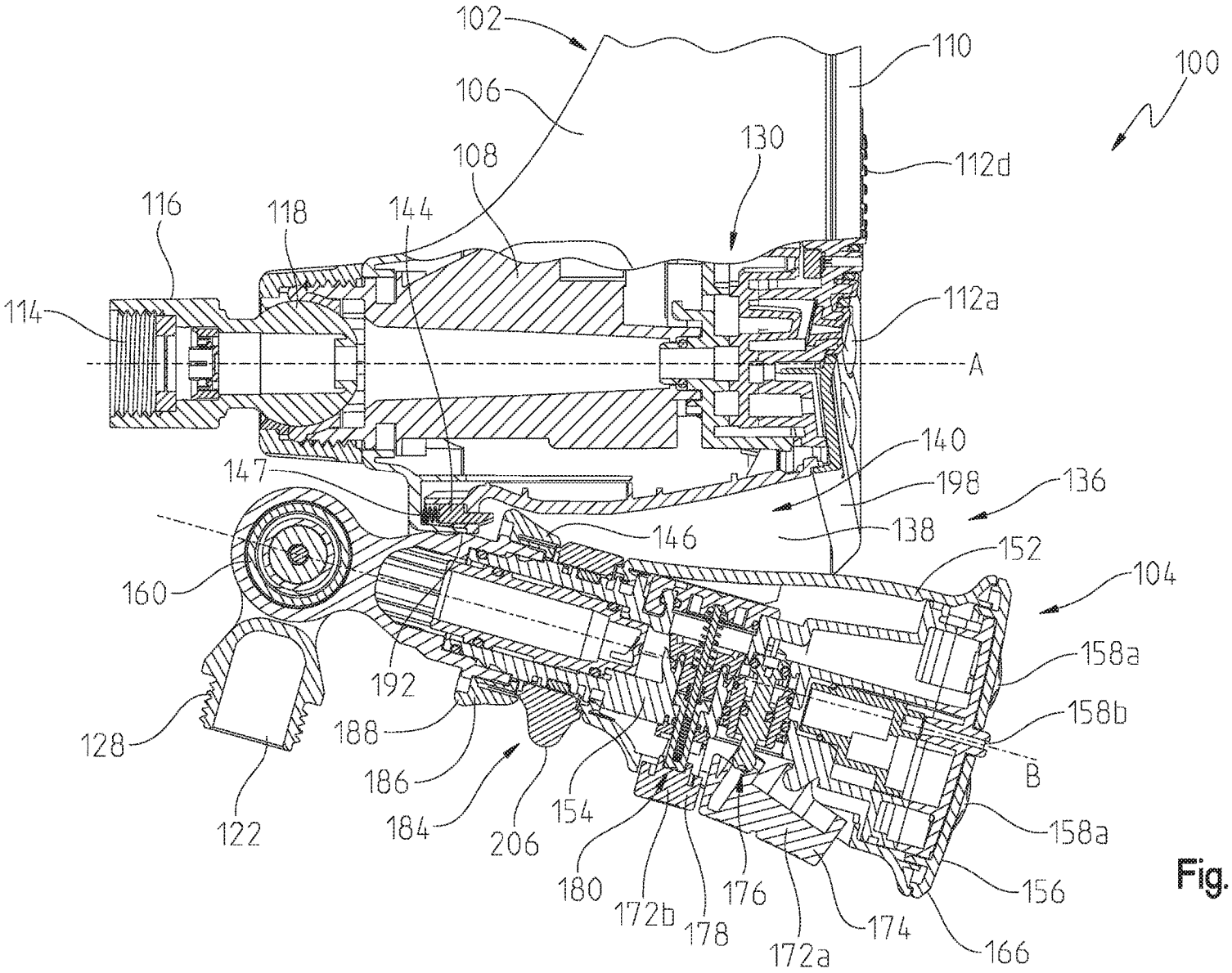
FIG. 3 is a cross-sectional view of the shower assembly of FIG. 1 taken along line 3-3, where the handheld shower is partially removed to illustrate a method of inserting and removing the handheld shower from the showerhead.
Figure 4:
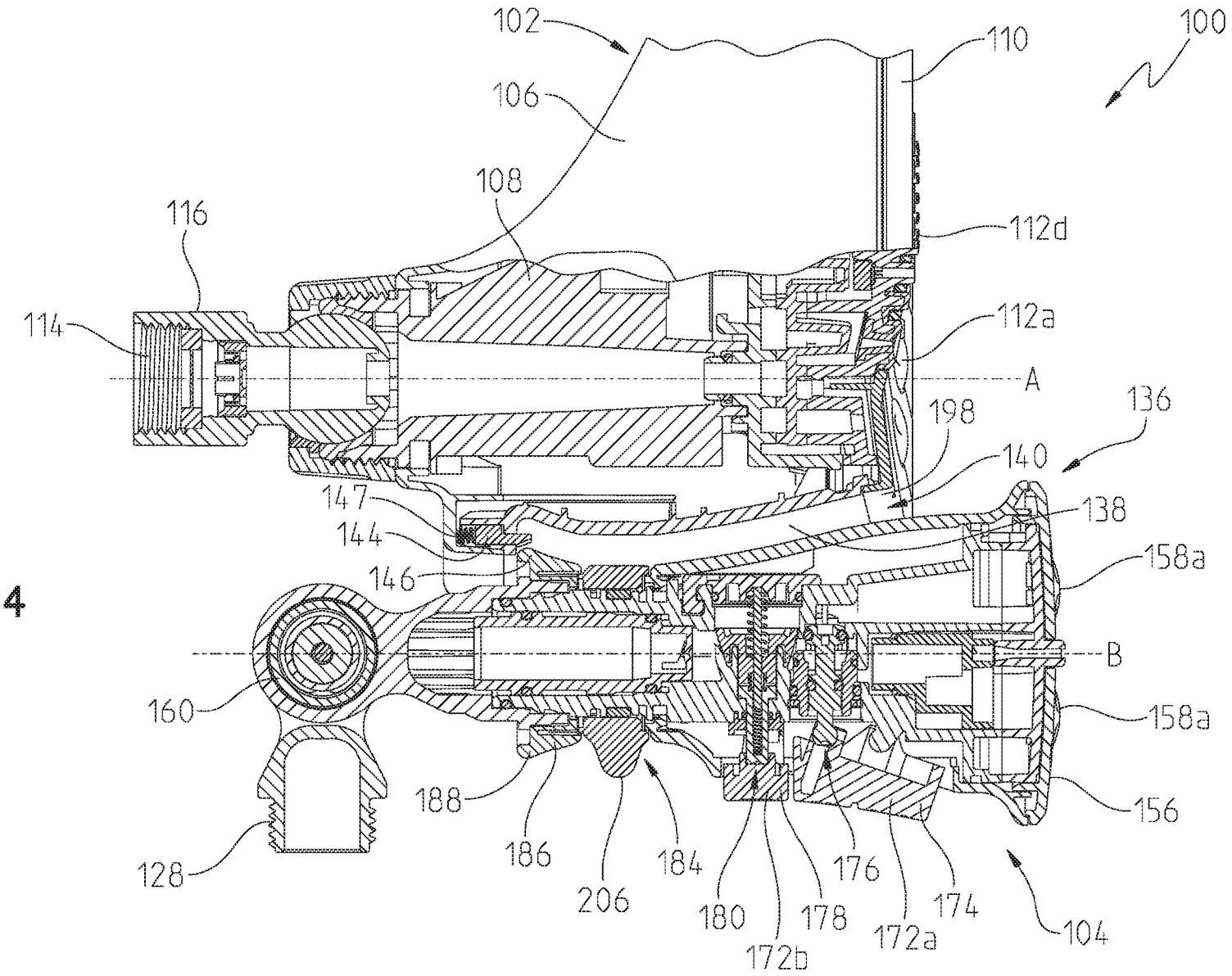
FIG. 4 is a cross-sectional view of the shower assembly of FIG. 1 taken along line 3-3, where the handheld shower is removed to illustrate another method of inserting the handheld shower into the showerhead.
Figure 5:
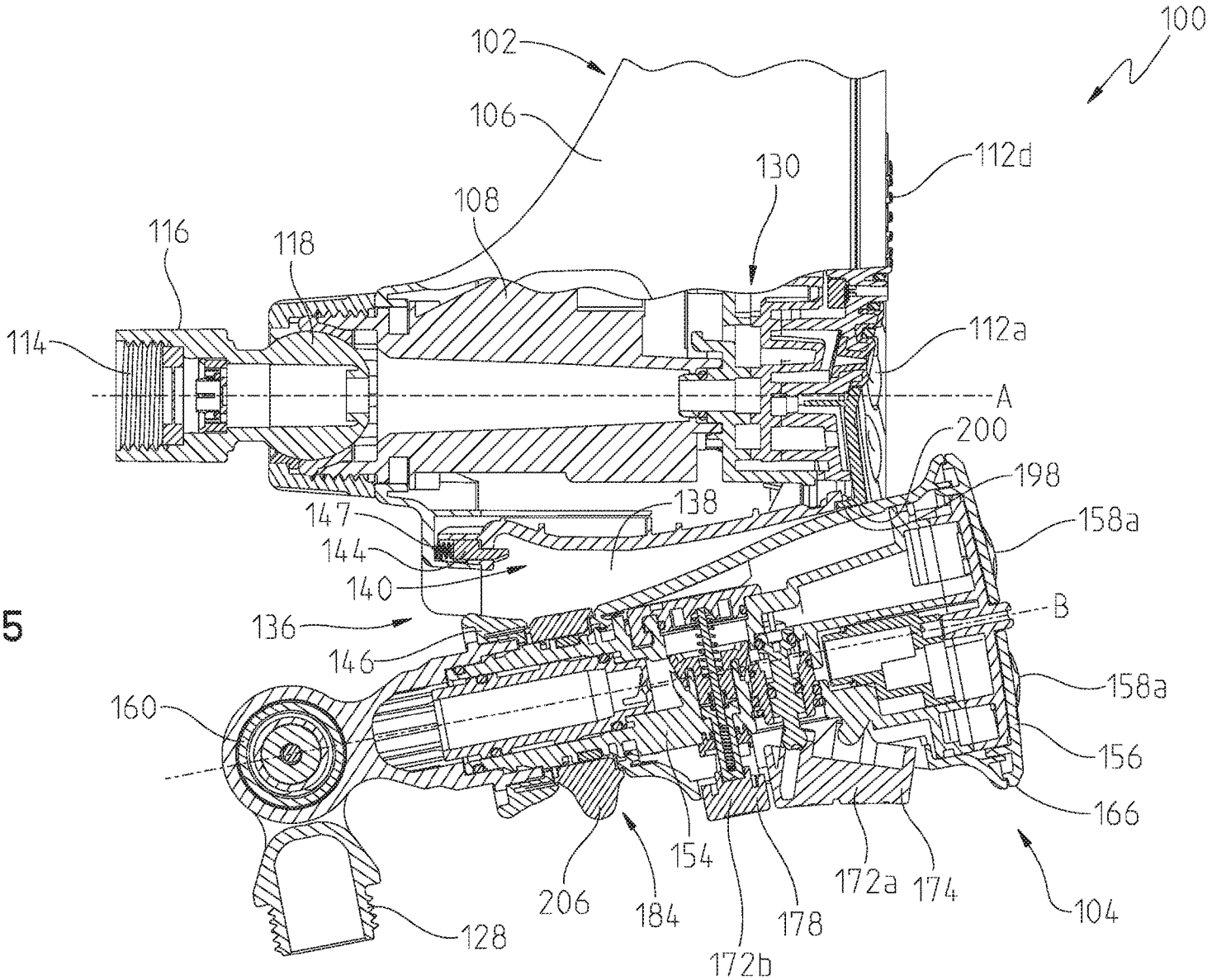
FIG. 5 is cross-sectional view of the shower assembly of FIG. 1 taken along line 3-3, where the handheld shower is partially removed to illustrate another method of inserting the handheld shower into the showerhead.

As mentioned earlier, handheld shower 104 and showerhead 102 are removably coupled to each other via a holder 136, as shown in FIG. 2. Showerhead 102 includes arcuate nest 138 forming recess 140. The nest 138 includes retractable, spring biased latch 144 positioned above a pair of docking protrusions 150. Protrusions 150 and latch 144 cooperate to receive handheld shower 104. FIGS. 3-5 illustrate various methods of inserting handheld shower 104 into nest 138 of showerhead 102 to couple showerhead 102 and handheld shower 104 to each other.

Figure 7:
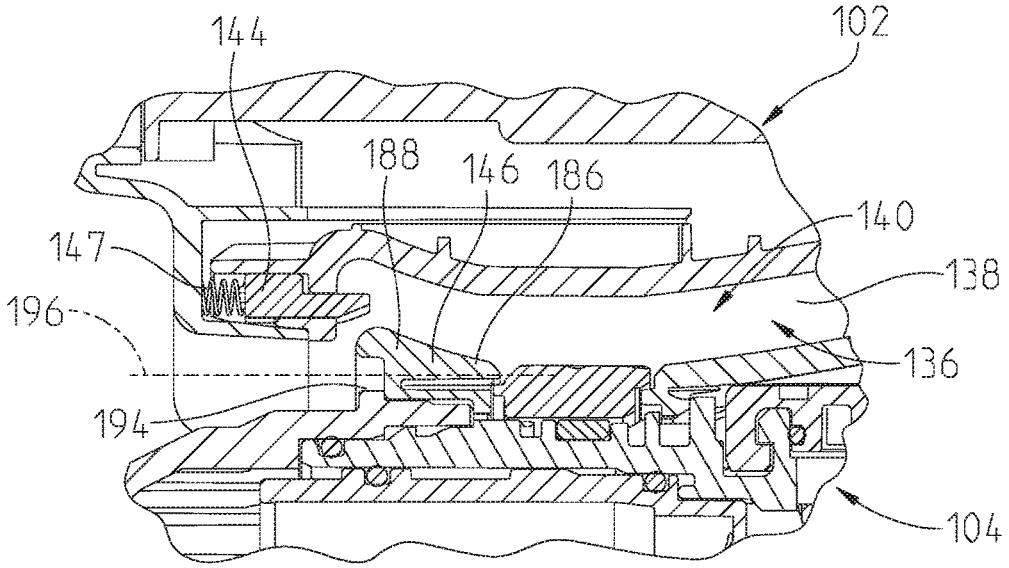
FIGS. 7-9 are cross-sectional views of a portion of the showerhead and the handheld shower to illustrate how the showerhead and handheld shower couple to one another.

As shown in FIG. 3, a proximal end of handheld shower 104 relative to hinge 160 engages with showerhead 102. This engagement serves as a proximal pivot point 192 about which handheld shower 104 is pivoted such that recess 194 (FIGS. 7-9) of retainer 146 receives retractable latch 144. Also, when handheld shower 104 is pivoted as described above, protrusions 150 of passage 140 engage with the outer surface of handheld shower 104 resulting in the mounted configuration shown in FIG. 1. In this configuration, latch 144 and protrusions 150 function to hold handheld shower 104 within recess 140.

An alternative method of coupling handheld shower 104 to showerhead 102 is shown in FIGS. 4 and 7-9. As handheld shower 104 is moved into recess 140 in the configuration of FIG. 7, axis B of handheld shower 104 is substantially parallel with axis A of showerhead 102.

Figure 8:
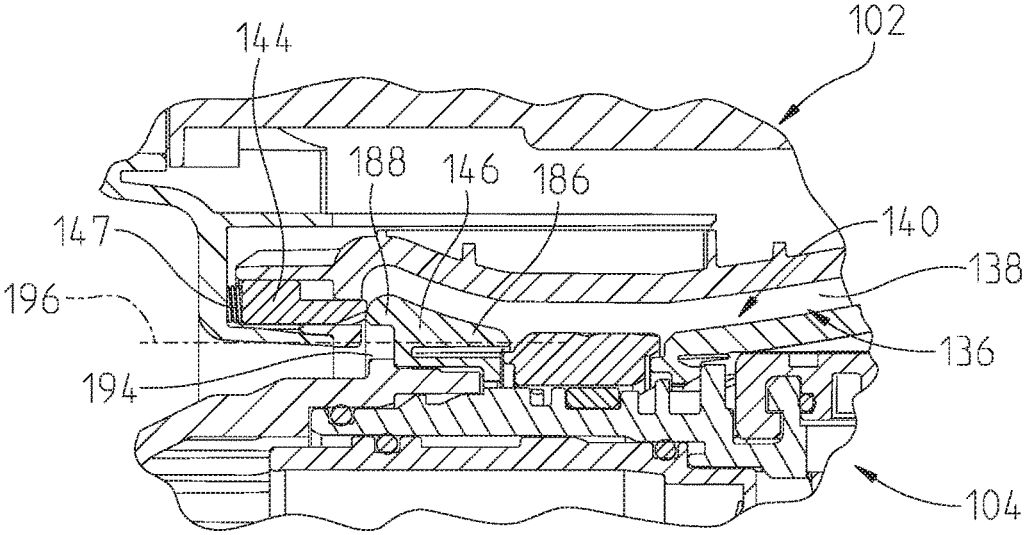

As handheld shower 104 is moved into recess 140 in the configuration of FIG. 8, axis A and axis B of showerhead 102 and handheld shower 104 remain substantially parallel with one another. Retainer 146 engages with retractable latch 144 such that spring 147, which is connected to retractable latch 144, is compressed. Compression of spring 147 retracts latch 144 to create space for further advancement of handheld shower 104 within recess 140.

Figure 9:
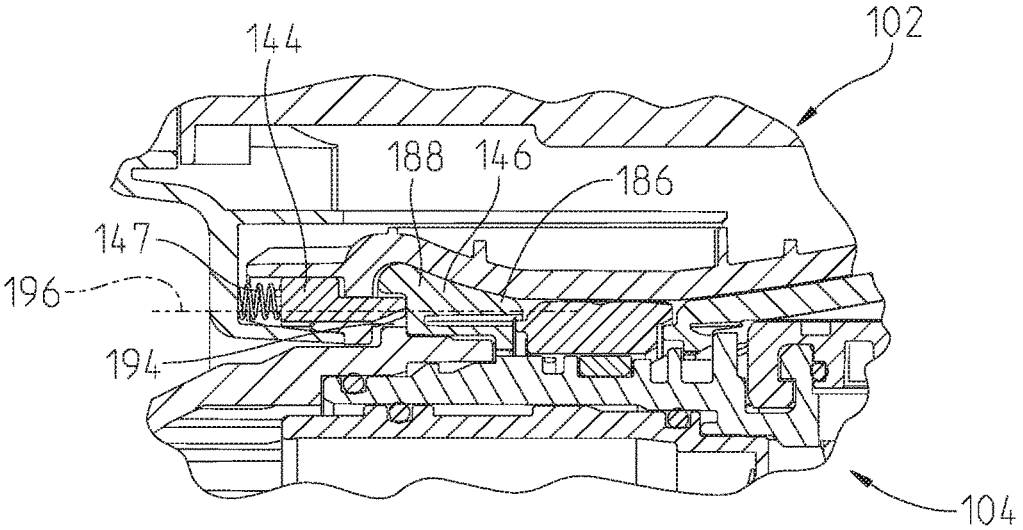

When handheld shower 104 is fully inserted into recess 140 as shown in the configuration of FIG. 9, spring 147 expands returning latch 144 to its original position where latch 144 is received within recess 194 of clip 146. Recess 194 has an axis 196 that is substantially parallel to axis B of handheld shower 104.

Within recess 194, latch 144 engages lip 188 of retainer 146 and provides an upward force on retainer 146 to secure and prevent handheld shower 104 from falling out of recess 140 in conjunction with the engagement of protrusions 150 with the outer surface of handheld shower 104. The engagement between latch 144 and retainer 146 also affects the method of removing handheld shower 104 from recess 140 as discussed further herein.

Referring to FIG. 5, a distal end of the handheld shower 104 is initially positioned at the location of a seat 198 within the nest 138. That is, seat 198 engages with the outer surface of handheld shower 104 such that handheld shower 104 can pivot about the point of engagement or distal pivot point 200. As handheld shower 104 is pivoted towards passage 140 of showerhead 102, retainer 146 engages with retractable latch 144 and spring 147 as described earlier in relation to FIGS. 7-9 which, in combination with protrusions 150 of passage 140 engage with the outer surface of the handheld shower 104, couples handheld shower 104 and showerhead 102 as shown in FIG. 1.

To remove handheld shower 104 from showerhead 102, handheld shower 104 is disengaged from protrusions 150, and handheld shower 104 is pivotable about retractable latch 144. In one embodiment, handheld shower 104 is disengaged from protrusions 150 by rotating handheld shower 104 about pivot point 192. However, it is within the scope of the present disclosure that other suitable means of disengaging handheld shower 104 from protrusions 150 can be employed. When handheld shower 104 is pivoted away from showerhead 102, retainer 146 pivots away from retractable latch 144. The retainer 146 may compress spring 147, thereby moving retractable latch 144 away from retainer 146 creating enough space to allow retainer 146 to disengage from latch 144 and facilitate subsequent removal of handheld shower 104 from recess 140. Due to engagement between the latch 146 and the retainer 146, the handheld shower 104 cannot be removed by simply pivoting about distal pivot point 200 (e.g., removal by pulling down orthogonal to axis B on proximal end 122).

Figure 6:
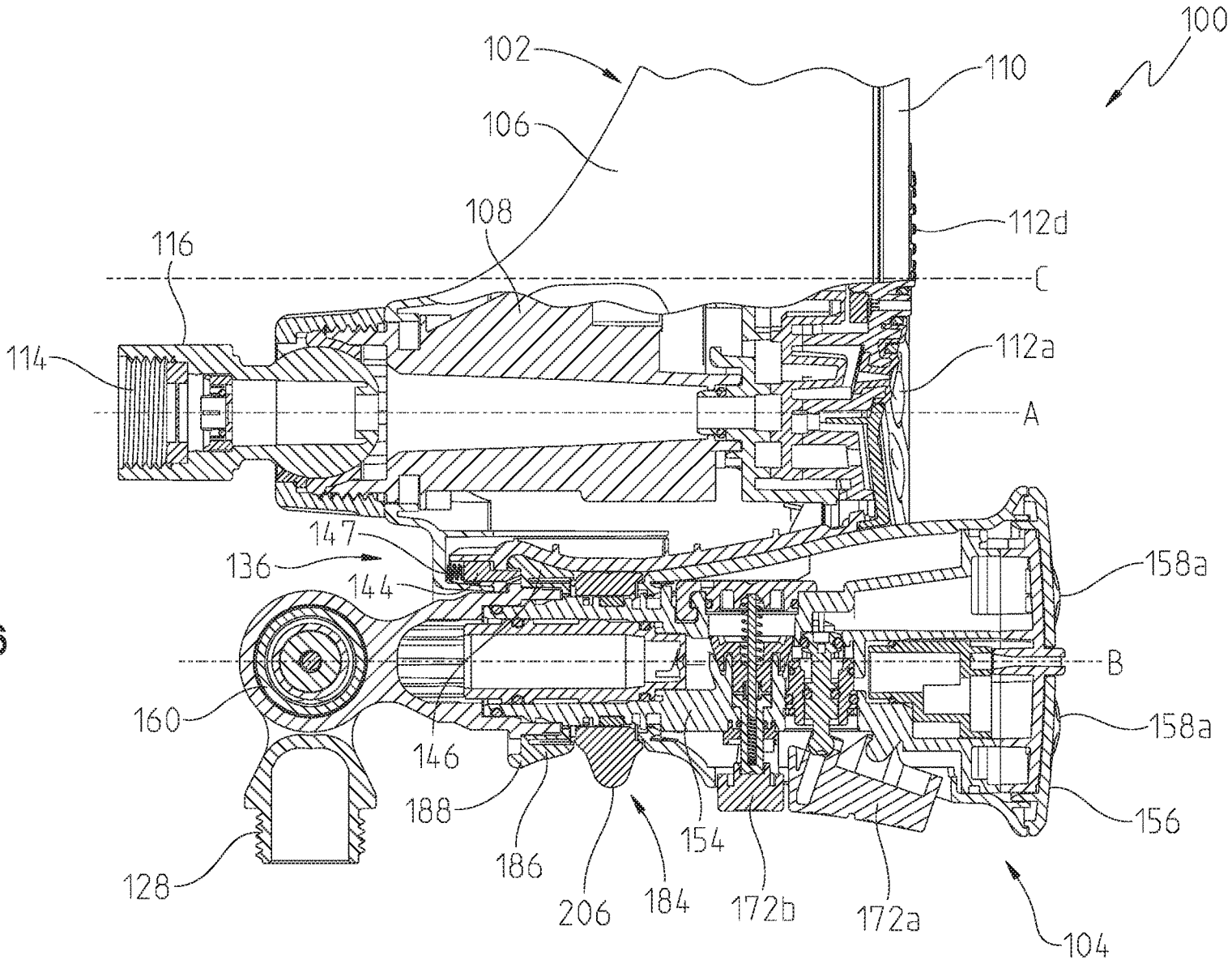
FIG. 6 is a cross-sectional view of the shower assembly of FIG. 1 taken along line 3-3, where the handheld shower is fully coupled to the showerhead.

With further reference to FIG. 6, the waterway 108 of showerhead 102 defines longitudinal axis A, and the waterway 154 and the coaxially aligned faceplate 156 of the handheld shower 104 define the longitudinal axis B. Longitudinal axis C is defined by the faceplate 110 of the showerhead 102. As shown in the illustrative embodiment of FIG. 6, when the handheld shower 104 is coupled to the holder 136 of the showerhead 102, axes A, B and C extend substantially parallel to each other with axis C positioned above axis A, and axis A positioned above axis B.

Figure 15:
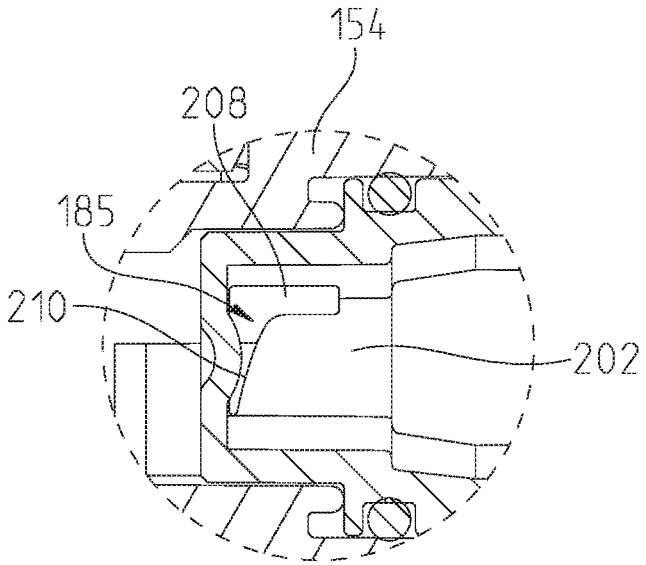
FIGS. 15-17 are cross sectional, elevational views of a portion of the handheld shower of FIG. 10 to illustrate the volumetric flow control of the handheld shower.
Figure 16:
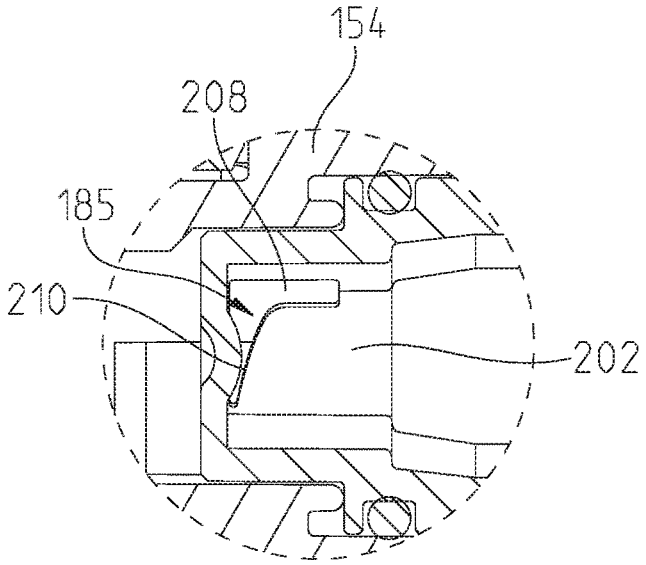
Figure 17:
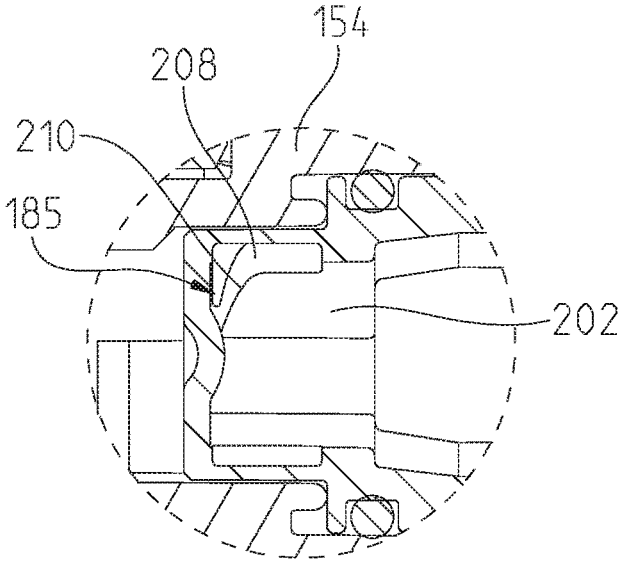

As mentioned earlier, handheld shower 104 includes a volumetric flow control 184, which controls the volumetric flow rate of water through outlets 158. A flow control member 202, illustratively a tubular member, is rotatably supported within the waterway 154. A coupling member 204, illustratively a clip, couples an outer interface ring 206 to the flow control member 202. Diametrically opposed openings 208 are formed in a distal end of the flow control member 202. Each opening 208 illustratively includes an inclined or arcuate flow control surface 210 to cooperate with diametrically opposed recesses 212 formed in the inner surface of the waterway 154, and define the flow control opening 185. Blocking surfaces 214 are defined by the waterway 154 between the recesses 212. As such, rotation of the flow control member 202 may alter the size (i.e., cross-sectional area) of the flow control opening 185 defined between the flow control member 202 and the waterway 154. As shown in FIGS. 15-17, flow control surface 210 moves in accordance with the setting of volumetric flow control 184. Moveable flow control surface 210 controls the size of flow control aperture 185 and in turn, the volumetric flow rate of water through aperture 185 and exiting through outlets 158.

With reference to FIG. 15, movable flow control surface 210 defines aperture 185 to be in an open configuration. That is, movable flow control surface 210 is spaced from blocking surfaces 214 (apertures 208 and recesses 212 overlap) such that water can flow through aperture 185 and outlets 158 of handheld shower 104.

FIG. 16 shows movable flow control surface 210 defining aperture 185 in a partially closed configuration. That is, movable flow control surface 210 partially closes aperture 185 such that water can flow through a portion of aperture 185 and out of outlets 158 of handheld shower 104.

As shown in FIG. 17, movable flow control surface 210 defines aperture 185 in a closed configuration. That is, movable flow control surface 210 is closed by blocking surface 214, such that aperture 185 is significantly blocked and water is restricted from flowing (i.e., reduced water flow) through outlets 158 of handheld shower 104.

Figure 18:
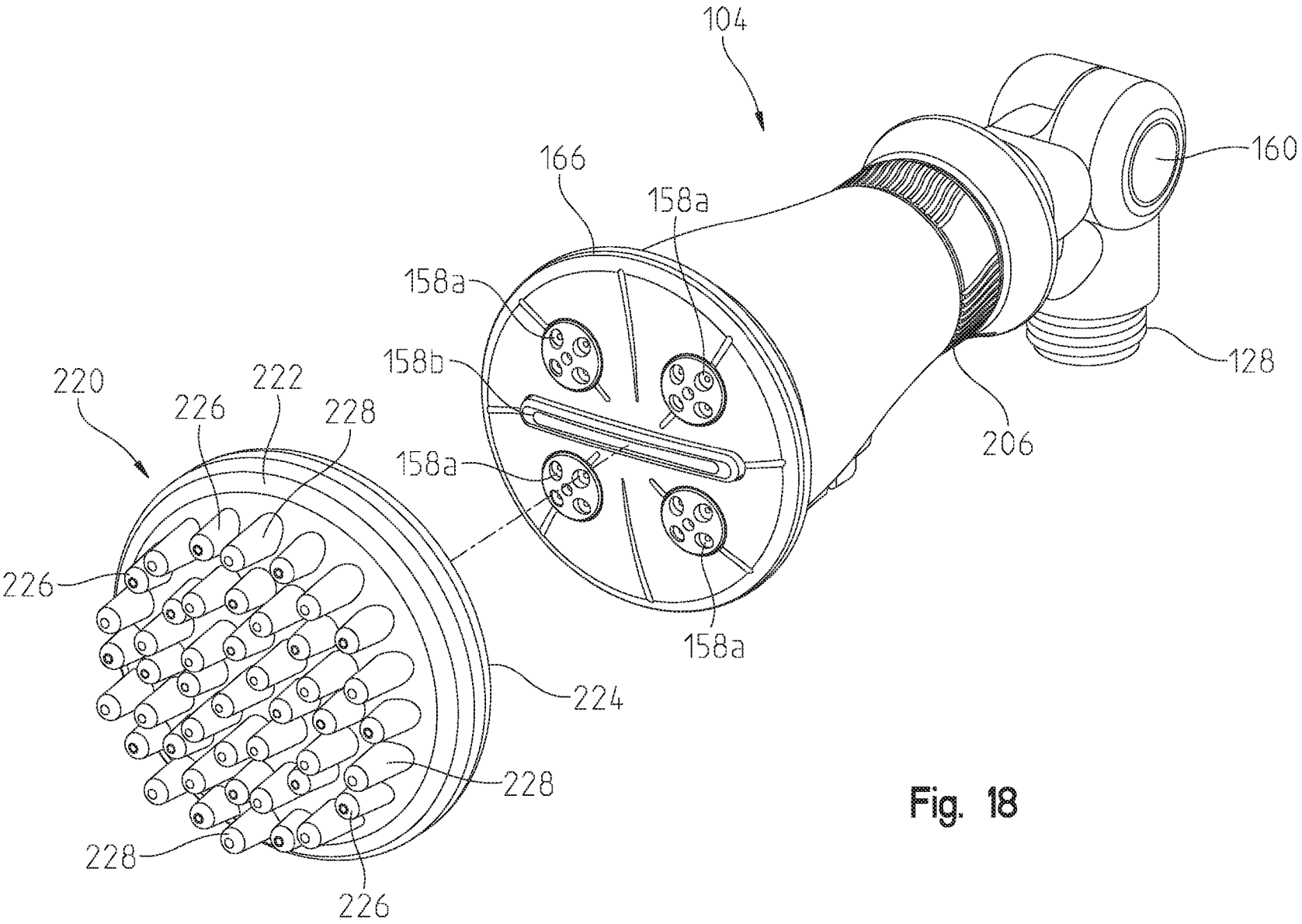
FIG. 18 is an exploded, perspective view of the handheld shower with an scrubbing attachment.
Figure 19:
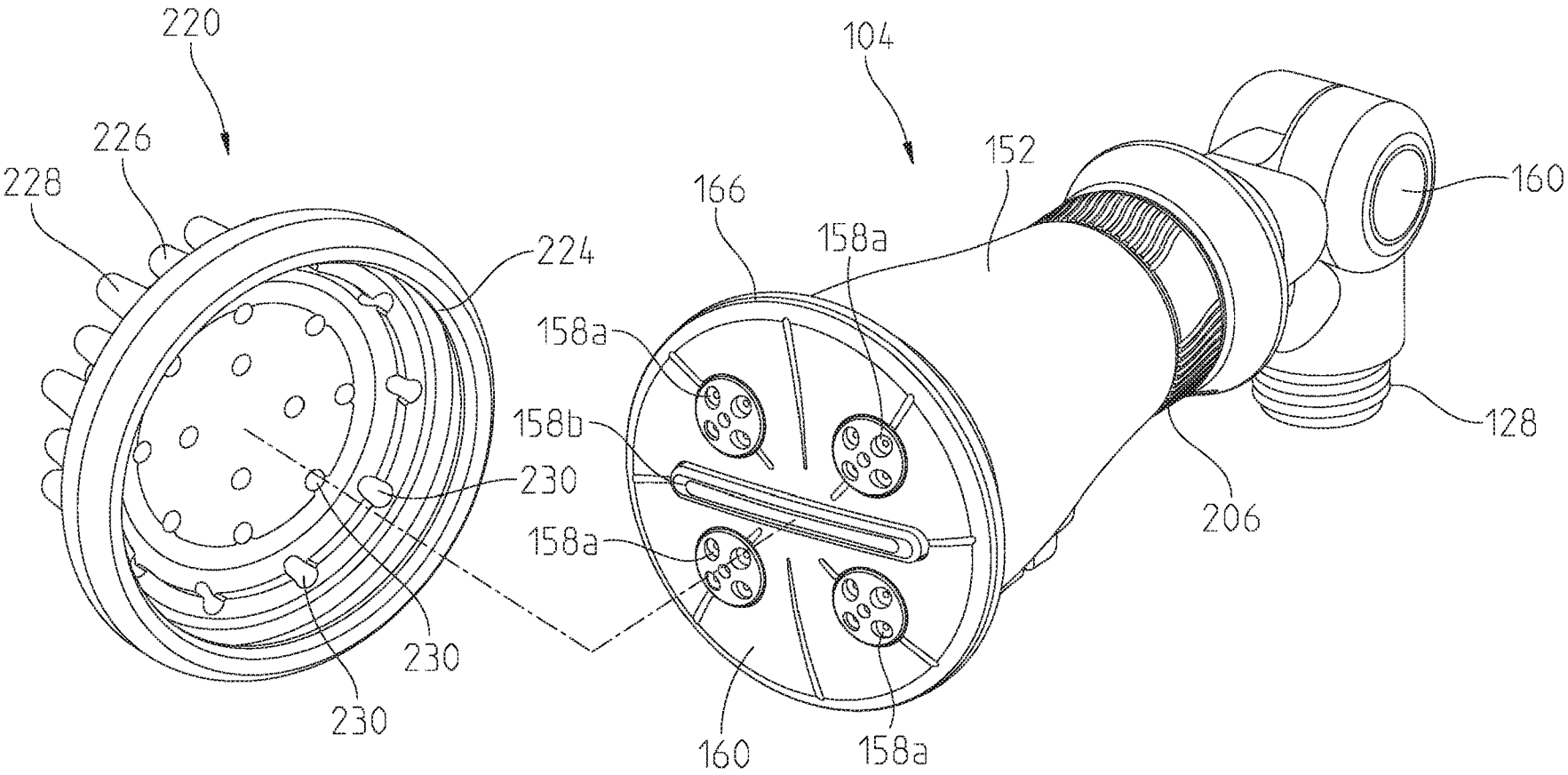
FIG. 19 is an exploded, perspective view of the handheld shower with the scrubbing attachment of FIG. 18 further illustrating the reverse side of the scrubbing attachment.

As mentioned earlier, handheld shower 104 may further include a scrubbing attachment 220 as shown in FIGS. 18 and 19. Scrubbing attachment 220 includes body 222 illustratively formed of an elastomer and having a rim 224 that frictionally couples to rim 166 of handheld shower 104. In an alternate embodiment, rim 224 of scrubbing attachment 220 may be in threaded engagement with handheld shower 104. However, it is within the scope of the present disclosure that other coupling methods may be used to couple scrubbing attachment 220 with handheld shower 104 (e.g., fasteners, clips, etc.).

As shown in FIGS. 18 and 19, scrubbing attachment 220 includes a plurality of scrubbing nubbins 226 and 228 extending outwardly from the body 222. Nubbins 226 include apertures 230 to provide water flow from the outlets 158 of the handheld shower 104. Nubbins 226 protrude from scrubbing attachment 220 and provide additional outlets from which water can exit. Scrubbing nubbins 228 are illustratively positioned intermediate nubbins 226 and do not include apertures. Instead, nubbins 228 are longer than nubbins 226 to provide a standoff and not hinder water flow from apertures 230 of nubbins 226 when being used to scrub an external surface during operation of handheld shower 104.

Figure 20:
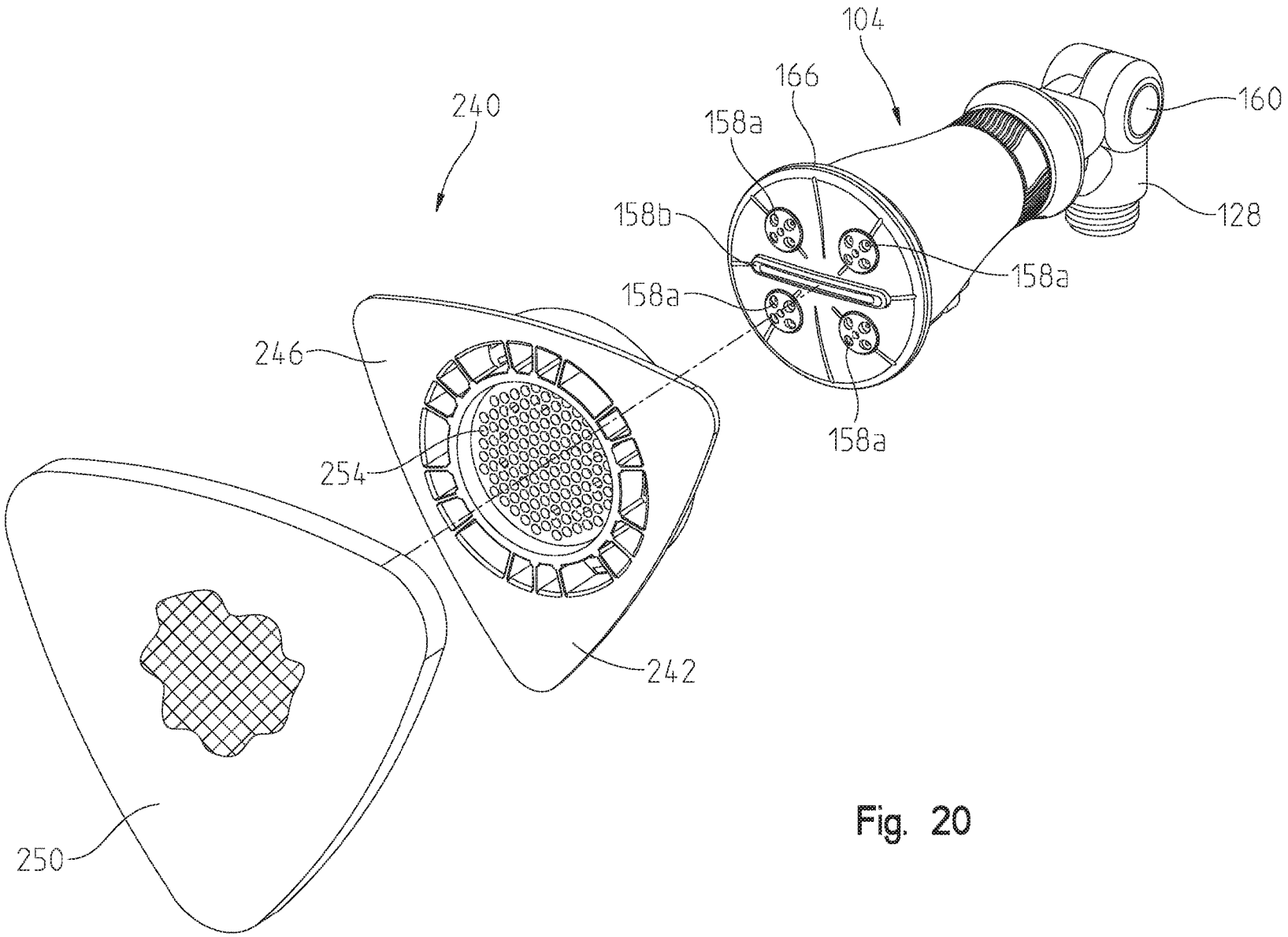
FIG. 20 is an exploded, perspective view of the handheld shower with an alternative scrubbing attachment and a cover for the scrubbing attachment.
Figure 21:
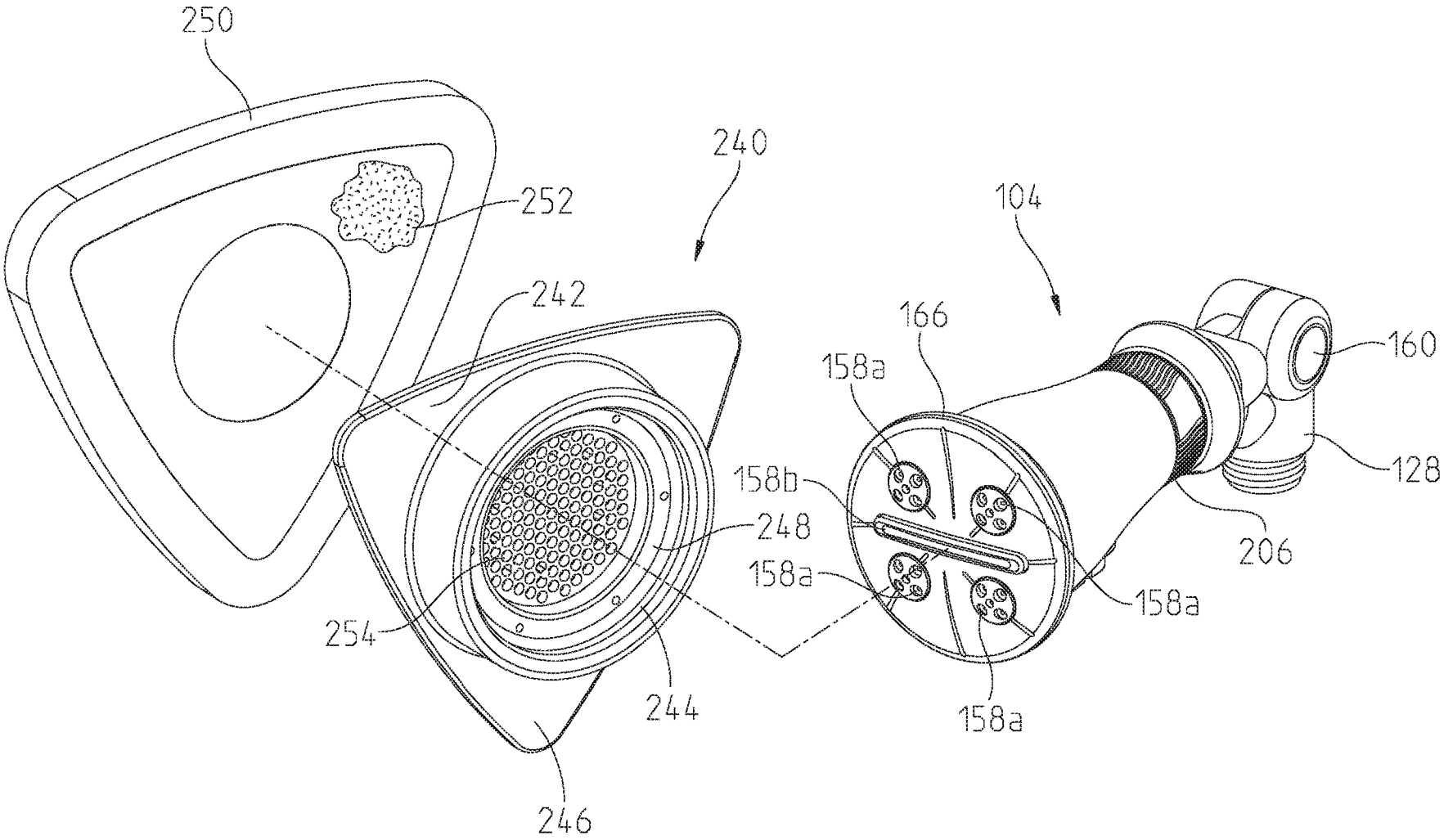
FIG. 21 is an exploded, perspective view of the handheld shower with the scrubbing attachment and cover of FIG. 20 further illustrating the reverse side of the scrubbing attachment and the cover.

Another illustrative scrubbing attachment 240 is shown in FIGS. 20 and 21. Similar to scrubbing attachment 220, scrubbing attachment 240 includes a base 242 defining a rim 244 that couples to rim 166 of handheld shower 104 in friction engagement. The base 242 includes a polymeric body 246 with an insert molded rubber coupler 248 defining the rim 244. A cover 250 is illustratively coupled to the base 242. A fastener 252 illustratively couples the base 242 to the cover 250. The fastener 252 may comprise a hook and loop fastener, adhesives, etc. In an alternate embodiment, rim 244 of scrubbing attachment 240 may be in threaded engagement with rim 166 of the handheld shower 104. However, it is within the scope of the present disclosure that other coupling methods may be used to couple scrubbing attachment 240 with handheld shower 104 (e.g., fasteners, clips, etc.).

Base 242 of scrubbing attachment 240 further includes apertures 254 that are in fluid communication with outlets 158 such that water exiting handheld shower 104 can flow through apertures 254 of scrubbing head attachment 240. As shown in FIGS. 20 and 21, the cover 250 couples to base 242 to provide a cleaning surface that can be applied to an object to be cleaned. Illustratively, the cover 250 may be formed of a mesh material, such as a nylon blend.

Although the invention has been described in detail with reference to certain preferred embodiments, variations and modifications exist within the spirit and scope of the invention as described and defined in the following claims.

What is claimed is:

1. A shower assembly comprising:

a showerhead including a faceplate having a plurality of outlets and defining a first longitudinal axis, the showerhead including:

a holder including an arcuate nest having a spring biased latch and a docking protrusion positioned below the spring biased latch:

a handheld shower removably coupled to the showerhead, the handheld shower including a proximal end, a distal end, and a faceplate at the distal end having a plurality of outlets and defining a second longitudinal axis, the handheld shower further including:

a retainer configured to couple with the spring biased latch;

the retainer including a recess having a third axis parallel with the second longitudinal axis, the spring biased latch configured to move along the third axis;

wherein when the handheld shower is coupled to the showerhead, the spring biased latch is received in the recess and the docking protrusion is coupled to the outer surface of the handheld shower;

a proximal pivot point proximate the proximal end; and wherein when the handheld shower is removed from the showerhead, the handheld shower pivots about the proximal pivot point such that the handheld shower is disengaged from the docking protrusion, and the retainer moves the spring biased latch relative to the showerhead to allow the retainer to disengage from the latch.

2. The shower assembly of claim 1, wherein the retainer further includes a clip, and the latch is coupled to a spring and when the handheld shower is being coupled to the showerhead, the clip engages the latch and compresses the spring.

3. The shower assembly of claim 1, wherein the handheld shower further includes a user interface to control a mode of the handheld shower.

4. The shower assembly of claim 1, further including a volumetric flow control operably coupled to a rotatable flow control member, wherein actuation of the volumetric flow control rotates the rotatable flow control member to control the size of a control opening and thereby, volumetric flow rate of water out of the handheld shower.

5. The shower assembly of claim 4, wherein:

the rotatable flow control member and the control opening are rotatable between an open configuration wherein water can flow through the aperture and the handheld shower, and a closed configuration wherein the control opening is obstructed by the rotatable flow control member and water is unable to flow through the control opening and the handheld shower.

6. The shower assembly of claim 5, wherein the rotatable flow control member and the control opening are in a partially closed configuration wherein a portion of water can flow through the control opening and the handheld shower.

7. The shower assembly of claim 1, wherein when the handheld shower is coupled to the showerhead, the first longitudinal axis, the second longitudinal axis, and the third axis are substantially parallel with each other.

8. The shower assembly of claim 1, wherein the handheld shower is coupled to a scrubbing attachment, the scrubbing attachment including a plurality of scrubbing nubbins with apertures that are in fluid communication with outlets of the handheld shower.

9. A shower assembly comprising:

a showerhead having a faceplate with a plurality of outlets;

a handheld shower fluidly coupled to the showerhead and extending between a proximal end and a distal end, the handheld shower including a shell, a waterway received within the shell, a faceplate coupled to the shell, the faceplate including a plurality of outlets fluidly coupled to the waterway, and a retainer coupled to the shell; and a holder configured to secure the handheld shower to the showerhead, the holder including an arcuate nest to receive the shell of the handheld shower, and a spring biased latch to receive the retainer of the handheld shower; wherein the handheld shower and the holder define a first coupling mode where the handheld shower pivots about a proximal pivot point proximate the proximal end of the handheld shower wherein the spring biased latch is received within the retainer of the handheld shower; and the handheld shower and the holder define a second coupling mode where the handheld shower pivots about a distal pivot point proximate the distal end of the handheld shower wherein the spring biased latch is received within the retainer of the handheld shower.

10. The shower assembly of claim 9, further comprising a pair of docking protrusions configured to engage an outer surface of the handheld shower.

11. The shower assembly of claim 9, wherein the handheld shower further includes a user interface to control a mode of the handheld shower.

12. The shower assembly of claim 9, further including a volumetric flow control operably coupled to a rotatable flow control member, wherein actuation of the volumetric flow control rotates the rotatable flow control member to control the size of a control opening and thereby, volumetric flow rate of water out of the handheld shower.

13. The shower assembly of claim 12, wherein:

the rotatable flow control member and the control opening are rotatable between an open configuration wherein water can flow through the aperture and the handheld shower, and a closed configuration wherein the control opening is obstructed by the rotatable flow control member and water is unable to flow through the control opening and the handheld shower.

14. The shower assembly of claim 13, wherein the rotatable flow control member and the control opening are in a partially closed configuration wherein a portion of water can flow through the control opening and the handheld shower.

15. A shower assembly comprising:

a showerhead including a faceplate having a plurality of outlets and defining a first longitudinal axis the showerhead including:

a holder including a spring biased latch and a docking protrusion;

a handheld shower removably coupled to the showerhead, the handheld shower including a faceplate having a plurality of outlets and defining a second longitudinal axis, the handheld shower further including:

a retainer configured to couple with the spring biased latch;

the retainer including a recess having a third axis parallel with the second longitudinal axis, the spring biased latch configured to move along the third axis;

wherein when the handheld shower is coupled to the showerhead, the spring biased latch is received in the recess and the docking protrusion is coupled to the outer surface of the handheld shower;

wherein when the handheld shower is removed from the showerhead, the handheld shower pivots about the spring biased latch relative to the showerhead; and wherein when the handheld shower is removed from the showerhead, the retainer moves the spring biased latch away from the retainer to provide space to permit the retainer to disengage from the spring biased latch.

* * * * *